US006327736B1

(12) United States Patent
Schaefer et al.

(10) Patent No.: US 6,327,736 B1
(45) Date of Patent: Dec. 11, 2001

(54) BRISTLE FOR A TOOTHBRUSH

(75) Inventors: Norbert Schaefer, Frankfurt; Armin Schwarz-Hartmann, Albig, both of (DE); Mingchih M. Tseng, Hingham, MA (US); Helge Zimmet, Somerville, MA (US); Scott Batson, Wakefield, MA (US); Georges Driesen, Weilrod (DE); Ahmet Cem Firatli, Wiesbaden (DE); Rainer Hans, Idstein (DE)

(73) Assignee: Braun GmbH, Frankfurt (DE)

( * ) Notice: Subject to any disclaimer, the term of this patent is extended or adjusted under 35 U.S.C. 154(b) by 0 days.

(21) Appl. No.: 09/283,600

(22) Filed: Apr. 1, 1999

Related U.S. Application Data

(63) Continuation of application No. PCT/EP97/05239, filed on Sep. 24, 1997.

(30) Foreign Application Priority Data

Oct. 2, 1996 (DE) ..... 196 40 726

(51) Int. Cl.[7] ..... D02G 3/00; A46D 1/00

(52) U.S. Cl. ..... 15/207.2; 264/173.16; 264/173.18; 264/173.19; 428/373; 428/374; 428/395

(58) Field of Search ..... 15/207.2; 428/373, 428/374, 394, 395; 264/173.16, 173.18, 173.19

(56) References Cited

U.S. PATENT DOCUMENTS

| | | | | |
|---|---|---|---|---|
| 3,327,339 | | 6/1967 | Lemelson . | |
| 4,263,691 | * | 4/1981 | Pakarnseree . | |
| 4,382,309 | | 5/1983 | Collis . | |
| 5,372,885 | * | 12/1994 | Tabor | 428/395 |
| 5,456,982 | * | 10/1995 | Hansen . | |
| 5,770,307 | * | 6/1998 | Rackley | 428/374 |
| 5,780,155 | * | 7/1998 | Ishizawa | 428/374 |
| 5,811,186 | * | 9/1998 | Martin . | |
| 5,888,651 | * | 3/1999 | Hoyt | 428/374 |
| 5,987,688 | * | 11/1999 | Roberts . | |

FOREIGN PATENT DOCUMENTS

| | | | | |
|---|---|---|---|---|
| 1 014 964 B | | 9/1957 | (DE) . | |
| 31 31 014 A1 | | 4/1982 | (DE) . | |
| 34 00 941 A1 | | 10/1984 | (DE) . | |
| 1 070 805 | | 8/1954 | (FR) . | |
| 1 523 212 | | 3/1968 | (FR) . | |
| 2137080 A | | 10/1984 | (GB) . | |
| 3219626 | * | 9/1988 | (JP) | 428/374 |
| 7009787 | * | 1/1971 | (NL) | 428/374 |
| WO 96/39117 | | 12/1996 | (WO) . | |

OTHER PUBLICATIONS

Fourné, Franz, *Synthetic Fibers: Machines and Equipment, Manufacture, Properties*, Chap.5.2 *Bi– and Multicomponent Yarns and Fibers*, pp. 539–548 (incl. footnotes list pp. 590–594), (Hanser/Gardner Pub., Inc., Cinicinnati, OH © 1999) (trans. by Hergeth and Mears).

Republished PCT WO 96/39117 dated Dec. 12, 1996, marked "Corrected Version" published with "Substitute Sheets".

Fourné, Franz, *Synthetische Fasern: Herstellung, Maschinen und Apparate*("Synthetic Fibers: Manufacturing, Machinery, Apparatus"), pp. 540–547 (Carl Hanser Verlag, Munich, © 1995).

PCT International Search Report mailed Feb. 12, 1998 in corresponding application PCT/EP97/05239 (with annex).

* cited by examiner

*Primary Examiner*—Randall E. Chin
(74) *Attorney, Agent, or Firm*—Edward S. Podszus

(57) ABSTRACT

The invention is directed to a bristle (1) suitable for use in a brush (4) or the like, and in particular in a toothbrush. The bristle (1) is made of a plastic material and includes preferably a circular area of cross-section. When viewed in cross-section, the bristle (1) includes two sections (2, 3) with different properties. These sections (2, 3) are not in concentric relative arrangement. As a result, the bristle (1) curves along its longitudinal axis. The curvature produces an improved cleaning action of the brush (4).

39 Claims, 2 Drawing Sheets

Fig. 1
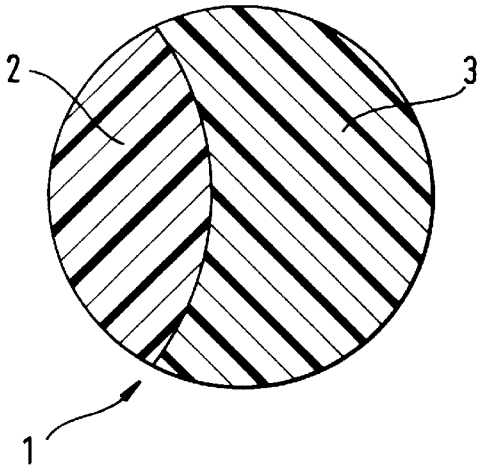
Fig. 2
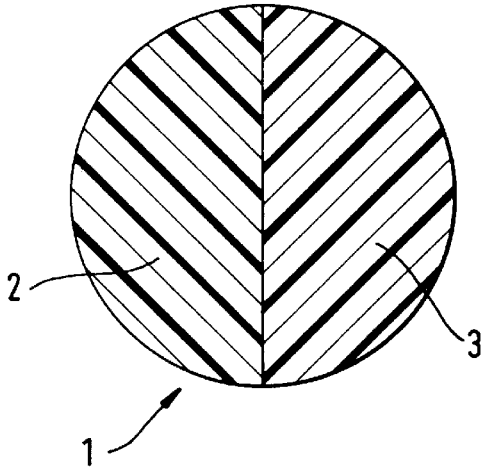
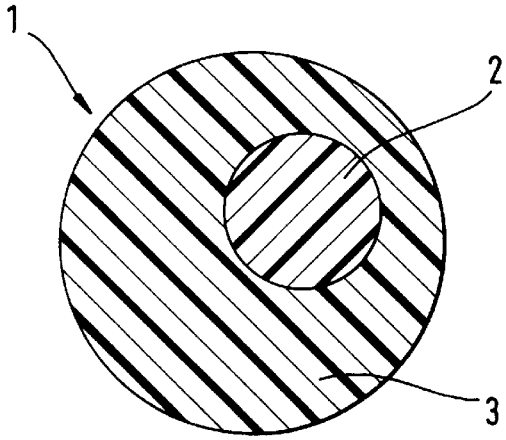
Fig. 3

BRISTLE FOR A TOOTHBRUSH

This is a continuation of International Application No. PCT/EP97/05239, abandoned, with an International filing date of Sep. 24, 1997.

This invention relates to a bristle for a brush or the like, in particular a toothbrush, in which the bristle is made of a plastic material and includes, when viewed in cross-section, two sections with different properties.

A bristle of this type is known, for example, from German Offenlegungsschrift DE 34 00 941 A1 (which appears to correspond to British application GB 2137080). This specification describes a plastic bristle having a hard core concentrically surrounded by a useful layer of a softer material. Core and useful layer may be manufactured from different plastic materials and differ in color. Attrition resulting from use of this bristle is automatically indicated to a user by a wearing down of the useful layer, exposing the different colored core. The two sections of the bristle do not, however, influence the cleaning action of a brush equipped with a plurality of such bristles.

From German Offenlegungsschrift DE 31 31 014 A1 (which appears to correspond to U.S. Pat. No. 4,382,309); a toothbrush is known with which the buccal-labial side and the lingual side of the teeth are cleaned simultaneously, enabling an improved cleaning action to be accomplished. For this purpose, the cleaning bristles of the toothbrush are shaped in the manner of two, for example, bent clusters of nylon threads with oppositely arranged ends. The cleaning bristles are manufactured by winding the nylon threads around a mandrel sufficiently often and allowing them to harden. Then the bent cleaning bristles are joined to the bristle holder of the toothbrush as by adhesive bonding.

SUMMARY OF THE INVENTION

It is an object of the present invention to provide a bristle of the type initially referred to which provides superior and gentler cleaning and is securable to a bristle holder with ease.

According to the present invention, this object is accomplished in that the sections are not in a concentric or point-symmetrical relative arrangement. Basically, any distribution pattern of the sections over the cross-section of the bristle is suited to provoke the effect disclosed in the invention in which the centers of gravity (also referred to as mass); of the surface areas of the sections do not coincide.

As a result of this arrangement of the two sections, the different properties of the two sections as, for example, their coefficients of expansion when subjected to moisture, heat or the like, are no longer in a position to balance each other. In consequence, the two sections expand differently, producing a curvature of the bristle along the bristle's longitudinal axis. Thus, the bristle experiences a lateral deflection away from the bristle's longitudinal axis.

By reason of its curvature, the bristle of the present invention also enables a gentler treatment of the object to be cleaned. Moreover, the lateral deflection of the bristle away from the bristle's longitudinal axis has the added effect of enabling the bristle to hug the object to be cleaned better, whereby a significantly better cleaning operation can be accomplished.

It is not necessary for the bristle of the present invention to be curved by particular manufacturing methods such as winding. Instead, the lateral deflection is accomplished simply by the arrangement of the two sections with their different properties as disclosed in the invention. This affords the further advantage of enabling the bristles of the present invention to be secured in a brush also by means of conventional simple manufacturing methods.

Particularly when the bristle of the present invention is utilized in a toothbrush, for example, an electric toothbrush, a substantially improved and at the same time gentler tooth cleaning operation can be accomplished by reason of the arrangement of the two sections as disclosed in this invention and the resultant curvature of the bristle. In addition to these advantages, the curvature of the bristle enables the bristle to better penetrate the interproximal spaces, producing therein likewise a substantially improved and at the same time gentler cleaning action. A still further advantage of the bristle of the present invention is that it affords ease and economy of manufacture of such a toothbrush.

In an advantageous feature of the present invention, one of the two sections forms a circular-segment-shaped surface area, with the connecting line between the two sections being, for example, an essentially straight line, a line shaped in the manner of the arc of a circle, or a curved line. In this feature, the lateral deflection is not influenced solely by the different properties of the two sections, but also by the distribution pattern of the two sections over the cross-section of the bristle.

In an advantageous further aspect of the present invention, each of the two sections forms a semicircular surface area. In this configuration, the lateral deflection of the bristle is substantially accomplished only by reason of the different properties of the two sections. This results in a particularly good and uniform lateral deflection of the bristle away from the bristle's longitudinal axis. Equally, this further aspect enables said deflection to be computed and thus predetermined particularly well. Finally, the configuration of the two sections as semicircular surface areas affords significant advantages in respect of bristle manufacture, in particular with a view to simplifying and standardizing the dies utilized for bristle manufacture.

On account of substantial manufacturing advantages, it is particularly suitable for the ratio of the cross-sectional areas of the two sections to have a value of between about 0.25 and about 1.0, or between 1.0 and 1.4, approximately, depending on whether the smaller or the larger area finds application as reference quantity.

In still another advantageous aspect of the present invention, the two sections have different expansion properties when subjected to moisture. In consequence, when the bristle encounters moisture, the amount of expansion of the two sections in the direction of the bristle's longitudinal axis will differ. This produces in turn the aforementioned curvature of the bristle along the bristle's longitudinal axis.

In particular when the bristle of the present invention is used in a toothbrush, for example, an electric toothbrush, the bristle is exposed to atmospheric humidity. The two sections of the bristle thereby expand to different degrees, producing the curvature or the lateral deflection of the bristle away from the bristle's longitudinal axis. This results in the previously mentioned advantages in respect of the cleaning action of the bristle and the gentle treatment of the object to be cleaned by the bristle.

In another advantageous feature of the present invention, the two sections have different shrinkage properties when exposed to heat. In this feature, the manufacturing process involves the steps of heating the bristle and subsequent cooling. This results in different amounts of expansion and shrinkage of the two sections along the bristle's longitudinal axis, causing the bristle to bend. The particular amount of deflection of the bristle away from the bristle's longitudinal axis may be set in the manufacturing process by a corresponding heating and cooling process. It is to be noted, however, that the deflection referred to is irreversible.

In still another advantageous feature of the present invention, a filler material and/or a nucleating agent, for example, kaolin, talcum or the like is/are added to the plastic material of one of the two sections. The addition of colorants is also possible. The effect thereby achieved is that different properties are imparted to the two sections, causing the bristle to deflect away from the bristle's longitudinal axis.

In yet another advantageous feature of the present invention, the two sections are formed of different plastic materials. This results again in different properties of the two sections, causing the bristle to exhibit a deflection away from the bristle's longitudinal axis when in use.

In this feature, the use of different plastic materials and filler materials and/or nucleating agents may be provided alternatively or cumulatively.

It is particularly suitable in the features described to fabricate the bristle from polyamide and/or polyester. These plastic materials have proven to be particularly advantageous in particular in toothbrushes. It is possible to utilize only one of the two plastic materials to which a filler material and/or a nucleating agent is then added in one of the two sections, or alternatively, various types of one group of plastic may be used in the two sections of the bristle.

The bristle of the present invention exhibits a curvature or a lateral deflection relative to the bristle's longitudinal axis. This produces the aforementioned advantages in respect of the improved cleaning action of the bristle and the gentler treatment of the object to be cleaned by the bristle. Further, the bristle of the present invention enables known, simple, manufacturing methods to be applied without the need for elaborate manufacturing operations to obtain the curvature.

In an advantageous feature of the present invention, the amount of deflection of the bristle is in the range of between about 10% and about 90%, of the length of the bristle, amounting in particular to about 50% of the length of the bristle. This has proven to be particularly suitable in practice as regards the cleaning action of the bristle.

In an advantageous further feature of the present invention, the two sections differ in color. This enables the effect of the curvature of the bristle to be seen. Particularly in the use of a plurality of bristles as in a toothbrush, a user will recognize the lateral deflection of the individual bristles from the differences in color, being thereby made specifically aware of the advantages regarding the cleaning action of the bristles.

It is particularly advantageous to utilize a plurality of the bristles of the present invention in a brush or the like, in particular in a toothbrush, in which the free ends of the bristles form a brush surface area. In this arrangement, the bristles are combined to form individual tufts of bristles constituting each a tuft surface area. The aggregate of the tuft surface areas of all bristle tufts is the brush surface area. In this case, the individual bristle tufts may fan out better, in particular in all directions, on the application of a force acting approximately in the direction of the tuft longitudinal axis. The result is a more uniform distribution of the free ends of the bristles and their lateral deflection. This deflection of the bristles is oriented in a random way, that is, there is no preferred direction for this particular deflection. Equally, by reason of the lateral deflection and the random orientation of the deflection, the individual bristles take support upon each other, reducing the possibility for the bristles to escape outwardly. Overall, an improved cleaning operation as well as a gentler treatment of the object to be cleaned is thereby accomplished.

In a particularly advantageous further feature of the present invention, the properties of the two sections of each of the bristles are dependent upon the arrangement of the bristle within the brush surface area. In other words, this means that in particular the curvature of a bristle depends upon the arrangement of this particular bristle within the brush surface area. In this manner, it is possible to provide a brush in which the curvatures of the individual bristles are adapted for the purpose of the brush, for example.

It is particularly suitable in this arrangement if the curvature of the bristles in the proximity of the outer edge of the brush surface area is smaller than that of the bristles in the inner zone of the brush surface area. This represents a particularly advantageous arrangement of the individual bristles in particular in a toothbrush. Because of the greater amount of deflection of the bristles in the inner zone of the toothbrush, the tooth surface to be cleaned is hugged and accordingly cleaned particularly well. It is also possible in this arrangement that essentially only the bristles in the inner zone of the toothbrush exhibit a curvature.

In still another advantageous feature of the present invention, the directions of deflection of the bristles are randomly distributed. This means that the deflections of the bristles of a tuft have no preferred direction. As a result, the bristle tips have different orientations, and the individual bristles bend in different directions. This is a further improvement particularly of a toothbrush with a view to the bristles hugging the tooth to be cleaned as uniformly and completely as possible. In addition, as a result of the random orientation of the bristles in different directions, one of the bristles is invariably arranged such as to enable it to penetrate the interproximal space to be cleaned particularly readily, without the need to press or turn the toothbrush against the tooth surfaces for this purpose. This results at the same time in a gentler treatment of a user's gums by the toothbrush of the present invention.

In a method of manufacturing the bristle of the present invention, either two different plastic materials may be coextruded, or one plastic material may be coextruded while a filler material is added to a particular section. In either event, it is particularly advantageous to arrange the connecting lines between the two sections associated with the individual nozzle bores of the extrusion die in a turned relationship to each other. In this way, a random arrangement of the two sections of the bristles and thus a random orientation of the deflection of the bristles is accomplished.

Further features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summary in the claims and their back-reference.

BRIEF DESCRIPTION OF THE DRAWINGS

FIG. 1 is a schematic cross-sectional view of a bristle of the present invention illustrating a first embodiment thereof;

FIG. 2 is a schematic cross-sectional view of a bristle of the present invention illustrating a second embodiment thereof;

FIG. 3 is a schematic cross-sectional view of a bristle of the present invention illustrating a third embodiment thereof;

DETAILED DESCRIPTION OF PREFERRED EMBODIMENTS

Figure 4:
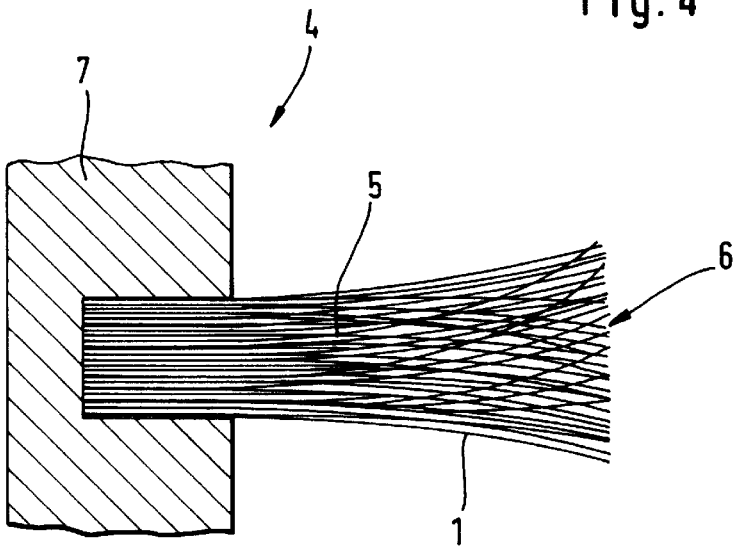
FIG. 4 is a schematic side view of a brush of the present invention comprised of a plurality of the bristles of FIG. 1 or FIG. 2 or FIG. 3.

Referring now to FIGS. 1 to 3, there is shown a bristle 1 in cross-sectional view, which is suitable for use in a toothbrush, for example, an electric toothbrush. The bristle 1 is made of a plastic material with an approximately circular area of cross-section. The bristle 1 includes two sections 2, 3 extending along the full length of the bristle's longitudinal axis. The two sections 2, 3 are not in concentric or point-symmetrical relative arrangement.

In FIG. 1, the two sections 2, 3 of the bristle 1 differ in size. Section 2 forms a circular-segment-shaped surface area, while section 3 forms the balance of the circular cross-sectional area of the bristle 1. The connecting line between section 2 and section 3 is shaped in the manner of the arc of a circle. The ratio of the areas of cross-section of the two sections 2, 3 has a value of between about 0.25 and about 1.0, or between 1.0 and 4.0, approximately.

In FIG. 2, the two sections 2, 3 of the bristle 1 are of equal size. The ratio of the cross-sectional areas of the two sections 2, 3 is thus 1. Each of the two sections 2, 3 forms a semicircular surface area. The connecting line between the two sections 2, 3 is substantially rectilinear.

In FIG. 3, the section 2 forms a circular area located within the section 3. The radius of the circular area of section 2 is smaller than the radius of the circular area of section 3. The circular area of section 2 is not concentric with the circular area of section 3. The ratio of the areas of cross-section of the two sections 2, 3 has a value of between about 0.25 and about 1.0, approximately, or between 1.0 and 4.0, approximately.

The two sections 2, 3 of the bristle 1 illustrated in FIGS. 1 to 3 possess different properties.

Rather than composing the bristle 1 of only two sections 2, 3, the invention further contemplates the provision of three or more sections. In this event, it is necessary for the sections to differ from each other such that asymmetrical properties result over the full cross-section of the bristle 1.

In the bristle 1 of FIGS. 1 to 3, the different properties of the, sections 2, 3 may be obtained by making section 2 of a plastic material different from that of section 3, or by using different types of the same group of plastic materials in the sections 2, 3. Equally, it is possible to add to the plastic material of one of the sections 2, 3 one or several filler materials and/or one or several nucleating agents. Further, colorants may also be used as additives. All these are possibilities which, when used alternatively or cumulatively, may cause the two sections 2, 3 of the bristle 1 of FIGS. 1 to 3 to exhibit different properties.

Polyamide or polyester may be used as plastic materials. As fillers and/or nucleating agents, calcium carbonate, talcum or a silicate such as kaolin or the like may be used.

The different properties of the two sections 2, 3 of FIGS. 1 to 3 may involve differences in expansion of the bristle 1 due to the absorption of moisture, in particular water, in the two sections 2, 3. This means that in taking up moisture, section 2 will expand in the bristle's longitudinal direction differently, for example, more severely, than section 3 of the bristle 1. This process is conventionally reversible, meaning that when the bristle is dried, said expansion will revert substantially to its original condition.

Alternatively or cumulatively, the different properties of the two sections 2, 3 of FIGS. 1 to 3 may involve differences in shrinkage of the bristle 1 due to heating and subsequent cooling. This means that on cooling section 2 will shrink differently, for example, more severely, than section 3 of the bristle 1. This process is irreversible, meaning that shrinkage due to heating and cooling will be maintained upon cooling of the bristle 1.

As a result of the different properties of the two sections 2, 3 of the bristle 1 obtained, for example, by virtue of the different properties of expansion due to the absorption of moisture and/or the different shrinkage properties due to heating, and as a result of the non concentric relative arrangement of the two sections 2, 3, the bristle 1 is curved along its longitudinal axis. This means that the bristle 1 is laterally deflected or slanted away from its longitudinal axis.

The amount of deflection of the bristle 1 may be between about 10% and about 90%, of the length of the bristle 1. Particularly preferred is a value of about 50% of the length of the bristle 1. In cases where the bristle 1 has two sections 2, 3 of equal size as illustrated in FIG. 2 and assuming a bristle length of 8 mm, approximately, said deflection is accomplished by differences in expansion or shrinkage of the two sections 2, 3 of between about 0.15% and about 1.5%.

The two sections 2, 3 of the bristle 1 of FIG. 1 as well as of FIG. 2 may be of different color. This may be considered in the selection of the different plastic materials for the two sections 2, 3 and/or in the selection of the filler material for one of the two sections 2, 3.

FIG. 4 shows a portion of a brush 4 with a tuft 5 of bristles. The tuft 5 includes a plurality of individual bristles 1 which may correspond to the bristles 1 of FIGS. 1 to 3. The brush 4 may be a toothbrush, for example, an electric toothbrush. The free ends of the bristles 1 of the tuft 5 for a tuft surface area 6. The plurality of the bristles 1 of the tuft 5 are fixed in a bristle holder 7 by means of an anchoring device or the like.

FIG. 4 shows the curvature of the individual bristles 1 along the bristle's longitudinal axis. It will be noticed further that as a result of the deflections of the plurality of bristles 1, the surface area 6 of the tuft 5 is larger than the area of cross-section of the tuft 5 of bristles 1 in the proximity of the bristle holder 7.

The individual bristles 1 of the tuft 5 are secured in the bristle holder 7 with different orientations. This means that the bristles 1 extend in different directions. In this arrangement, the deflection of the bristles 1 in the tuft 5 is random, causing the individual bristles 1 in the tuft 5 to be arranged in a purely random direction. In other words, this means that there is no preferred direction for the deflection of the bristles 1 in the tuft 5. This becomes equally apparent from FIG. 3.

The brush 4 of FIG. 4 includes a plurality of tufts 5. The aggregate of individual tufts 5 may be arranged within the brush 4 such that the surface areas 6 of the tufts 5 combine to form an approximately circular brush surface area. In this arrangement, the curvature of the bristles 1 of the tufts 5 in the proximity of the outer edge of the brush surface area may be smaller than the curvature of the bristles 1 of the tufts 5 in the inner zone of the brush 4. The possibility also exists that substantially only the bristles 1 of the tufts 5 in the inner zone of the brush 4 include a curvature.

To manufacture the bristles 1, filaments are produced by coextrusion, cut to the desired length of the bristles 1, assembled into clusters and secured in the bristle carrier 7 by means of a tufting operation and an anchoring device. In the coextrusion process, a non concentric or non point-symmetrical material distribution corresponding to the sections 2, 3 of FIGS. 1 to 3 is set.

Figure 5:
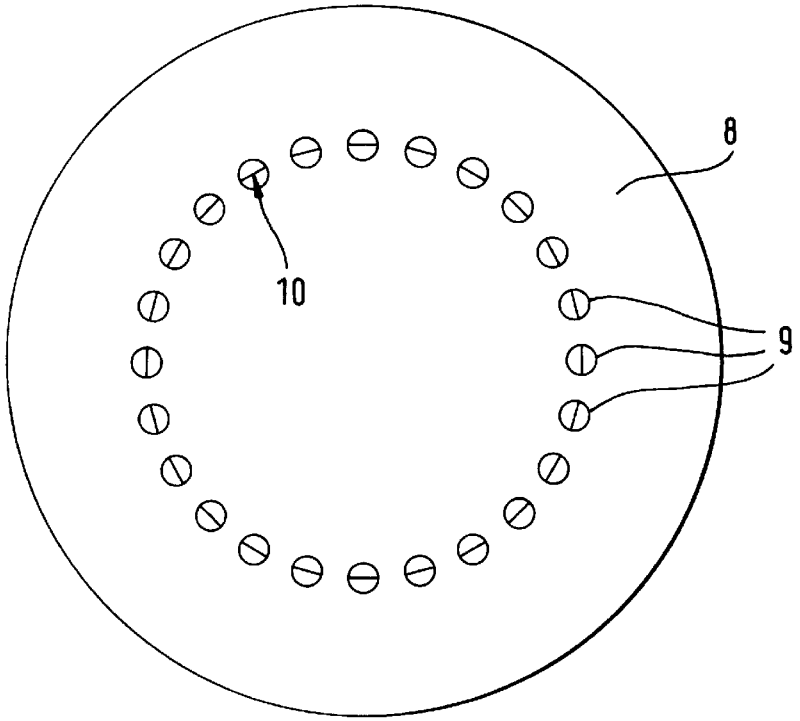
FIG. 5 is a schematic top plan view of a die for manufacturing the bristles of FIG. 2.

For this purpose, an extrusion die 8 of the type shown in FIG. 5 may be used, for example. This extrusion die 8 includes a plurality of nozzle bores 9 of like size approximately equidistantly spaced apart on a circular ring. Inside the extrusion die 8, each of the nozzle bores 9 is divided into two channels. At the point of convergence of the two channels, a connecting line 10 results where the two sections 2, 3 of the bristle 1 converge.

The connecting line 10 illustrated in FIG. 5 is approximately rectilinear. Insofar the bristle 1 of FIG. 2 is produced by the extrusion die 8 shown in FIG. 5. According to FIG. 5, the aggregate of the connecting lines 10 forms approximately a circle, and the lines are thereby arranged so as to be turned at a relative angle, being thus in different relative positions.

The extrusion die 8 enables two different plastic materials to be coextruded to produce a filament. Alternatively or cumulatively, it is possible with the extrusion die 8 to add a filler material and/or a nucleating agent to the plastic material in a respective one of the channels leading to the nozzle bores 9.

What is claimed is:

1. A toothbrush bristle and a bristle carrier together forming a toothbrush, said bristle comprising a plastic material and having a longitudinal axis and a cross-sectional area transverse said longitudinal axis, said bristle having a proximal end mounted in the bristle carrier and a distal free end, and said bristle cross-sectional area comprising a first bristle area portion and a second bristle area portion, and said first and second bristle area portions having dissimilar expansion properties and having their respective centers disposed apart from one another, whereby the bristle laterally deflects in response to differential expansion.

2. A toothbrush according to claim 1, wherein the dissimilar expansion properties of the first and second bristle area portions are dissimilar moisture absorption expansion properties, whereby the bristle deflects upon exposure to moisture in use.

3. A toothbrush according to claim 2, wherein the bristle deflection is substantially reversible upon reducing an absorbed moisture content of the bristle.

4. A toothbrush according to claim 2, wherein the dissimilar expansion properties of the first and second bristle area portions further comprise dissimilar thermal expansion properties.

5. A toothbrush according to claim 1, wherein the dissimilar expansion properties of the first and second bristle area portions are dissimilar thermal expansion properties.

6. A toothbrush according to claim 5, wherein upon heating the first and second area portions and subsequently cooling the portions, differential shrinkage results in the bristle deflection being substantially irreversible.

7. A toothbrush according to claim 1, wherein the dissimilar expansion properties of the first and second bristle area portions comprise dissimilar thermal expansion properties, wherein upon heating the first and second area portions and subsequently cooling the portions, differential shrinkage causes a substantially irreversibly deflected bristle original condition, and the dissimilar expansion properties of the first and second bristle area portions further comprise dissimilar moisture absorption expansion properties so that the bristle deflects away from said original condition upon exposure to moisture in use, and whereby the bristle reverts substantially to said deflected original condition upon bristle drying.

8. A toothbrush according to claim 1, wherein said first and second bristle area portions have respective centers of mass that are not coincident.

9. A toothbrush according to claim 1, wherein at least one of the first and second bristle area portions is shaped as at least a portion of a circular segment.

10. A toothbrush according to claim 1, wherein an interface formed between the first and second bristle area portions comprises in cross-section a shape selected from a group of shapes consisting of a substantially straight line, a rectilinear segment, an are of a circle, and a curve.

11. A toothbrush according to claim 1, wherein the first and second bristle area portions are approximately semicircular.

12. A toothbrush according to claim 11, wherein an interface formed between the first and second bristle area portions is substantially a straight line.

13. A toothbrush according to claim 11, wherein the first and second bristle area portions are about equal.

14. A toothbrush according to claim 1, wherein a ratio of areas between the first and second bristle area is at least about one-fourth.

15. A toothbrush according to claim 1, wherein a ratio of areas between the first and second bristle area is between about 1:4 and 1:1.

16. A toothbrush according to claim 1, wherein at least one of the first and second bristle area portions comprises an additive.

17. A toothbrush according to claim 16, wherein the additive is selected from a group of additives consisting of a filler material, a nucleating agent, and a colorant.

18. A toothbrush according to claim 16, wherein the additive is selected from a group,of additives consisting of kaolin, calcium carbonate, talcum, and silicates.

19. A toothbrush according to claim 1, wherein the first and second bristle area portions comprise dissimilar plastics.

20. A toothbrush according to claim 1, wherein the bristle plastic material is chosen from a group of plastics consisting of polyamide and polyester.

21. A toothbrush according to claim 1, wherein bristle deflection curves along its longitudinal axis between said bristle proximal end and said bristle distal end.

22. A toothbrush according to claim 1, wherein an amount of bristle deflection is between about 10% and about 90% of a bristle length.

23. A toothbrush according to claim 22, wherein the deflection is about 50% of the bristle length.

24. A plurality of toothbrush bristles according to claim 1 in combination with the toothbrush, wherein a first group of said plurality of bristles comprises bristles whose expansion coefficients between said first and second bristle area portions differ by a first quantity, and wherein an other group of said plurality of bristles comprises bristles whose expansion coefficients between said first and second bristle area portions differ by a second quantity which is different from said first quantity, wherein said distal free ends of the plurality of bristles collectively define a brush surface area, and wherein bristles of said first group of bristles undergo a different amount of deflection than bristles of said other group of the plurality of bristles according to the difference between the first and second quantities.

25. The combination according to claim 24, wherein the first group of bristles is disposed within a first region within the brush surface area, and the other group of bristles is disposed within a second region within the brush surface area, said second region being spatially removed from said first region.

26. The combination according to claim 25, wherein the first region is an inner zone and the second region is a peripheral region of the brush surface area, and the first and second quantities representing the differential expansion characteristics of the bristles are chosen so that deflections of the bristles of the first group of bristles located in the inner zone of the brush surface area are greater than deflections of bristles of the other group of bristles located in the peripheral region of the brush surface area.

27. A toothbrush according to claim 1 further comprising a plurality of said bristles mounted on said bristle carrier, wherein the bristles are arranged to deflect in a plurality of directions.

28. A toothbrush according to claim 27 wherein the bristle deflection directions are randomly distributed.

29. A toothbrush according to claim 1, further comprising at least a third bristle area portion having an expansion property dissimilar to that of at least said first bristle area portion.

30. A toothbrush according to claim 1, wherein the first and second bristle area portions are not concentric.

31. A toothbrush according to claim 1, wherein the first bristle area portion completely surrounds the second bristle area portion.

32. A toothbrush according to claim 1, wherein the first and second bristlearea portions are acentric.

33. A toothbrush bristle for a toothbrush having a bristle carrier, said bristle comprising a plastic material and having a longitudinal axis a cross-sectional area transverse said longitudinal axis, a proximal end mounted in the bristle carrier and a distal free end, and said bristle cross-sectional area comprising a first bristle area portion and a second bristle area portion, and said first and second bristle area portions having dissimilar expansion properties, whereby the bristle laterally deflects in response to differential expansion, and wherein the first and second bristle area portions further differ in color.

34. A toothbrush bristle according to claim 33, wherein the bristle plastic material is chosen from a group of plastics consisting of polyamide and polyester.

35. A bristle for a toothbrush having a bristle carrier, said bristle comprising a plastic material and having a longitudinal axis and a cross-sectional area transverse said longitudinal axis, said bristle having a proximal end mounted in the bristle carrier and a distal free end, said bristle cross-sectional area comprising a first bristle area portion and a second bristle area portion, said first and second bristle area portions having dissimilar coefficients of moisture absorption expansion or dissimilar coefficients of thermal expansion, and whereby a location of the first bristle area portion relative the second bristle area portion is such that the bristle distal free end laterally deflects relative the proximal mounted end in response to differential expansion of the first and second bristle area portions.

36. A toothbrush bristle according to claim 35, wherein the first and second bristle area portions have dissimilar moisture absorption expansion coefficients and dissimilar coefficients of thermal expansion, whereby the bristle deflects upon exposure to moisture and to heating.

37. A toothbrush bristle according to claim 35, wherein at least one of the first and second bristle area portions comprises an additive.

38. A toothbrush bristle according to claim 35, wherein the first and second bristle area portions comprise dissimilar plastics.

39. A toothbrush bristle according to claim 35, wherein the bristle plastic material is chosen from a group of plastics consisting of polyamide and polyester.

* * * * *

UNITED STATES PATENT AND TRADEMARK OFFICE

CERTIFICATE OF CORRECTION

PATENT NO. : 6,327,736 B1
DATED : December 11, 2001
INVENTOR(S) : Schaefer et al.

It is certified that error appears in the above-identified patent and that said Letters Patent is hereby corrected as shown below:

Column 8,
Line 18, change "are" to -- arc --;
Line 40, delete after "from a group" the comma to ",";

Column 9,
Line 37, change "bristlearea" to -- bristle area --; and
Line 40, after "axis" add a comma -- , --.

Signed and Sealed this

Fourth Day of June, 2002

*Attest:*

*Attesting Officer*

JAMES E. ROGAN
*Director of the United States Patent and Trademark Office*